United States Patent [19]

Lovendusky

[11] 4,066,326

[45] Jan. 3, 1978

[54] CIRCUIT BOARD CONTACT

[75] Inventor: Charles Michael Lovendusky, Enola, Pa.

[73] Assignee: E. I. Du Pont de Nemours and Company, Wilmington, Del.

[21] Appl. No.: 673,698

[22] Filed: Apr. 5, 1976

Related U.S. Application Data

[63] Continuation-in-part of Ser. No. 513,593, Oct. 10, 1974, abandoned.

[51] Int. Cl.[2] ..... H01R 9/16

[52] U.S. Cl. ..... 339/221 M; 339/17 C

[58] Field of Search ..... 339/17 R, 17 C, 214 R, 339/220 R, 220 T, 221 R, 221 M, 252 R, 252 P, 17 LC

[56] References Cited

U.S. PATENT DOCUMENTS

| | | | |
|---|---|---|---|
| 3,634,819 | 1/1972 | Evans | 339/252 P |
| 3,827,004 | 7/1974 | Heuvel | 339/221 R |
| 3,862,792 | 1/1975 | Jayne | 339/221 R |
| 3,997,237 | 12/1976 | White | 339/221 R |

*Primary Examiner*—Roy Lake
*Assistant Examiner*—Mark S. Bicks

[57] ABSTRACT

A circuit board contact is provided comprising a mounting portion and a solid, uniform cross section segment at each end of the mounting portion. The mounting portion includes three fins extending along a length thereof. Each fin includes an interior edge adjacent a central longitudinal axis of the mounting portion. The edges of the fins are separated along their length to provide the fins spring properties for retention of the mounting portion in a hole in a circuit board. Also provided is a method of inserting a pin in a hole in a circuit board comprising inserting a mounting portion of a contact in a hole in a ciruit board, supporting an end of the contact, and compressing the other end of the contact to expand the mounting portion and provide an interference fit in the hole.

8 Claims, 13 Drawing Figures

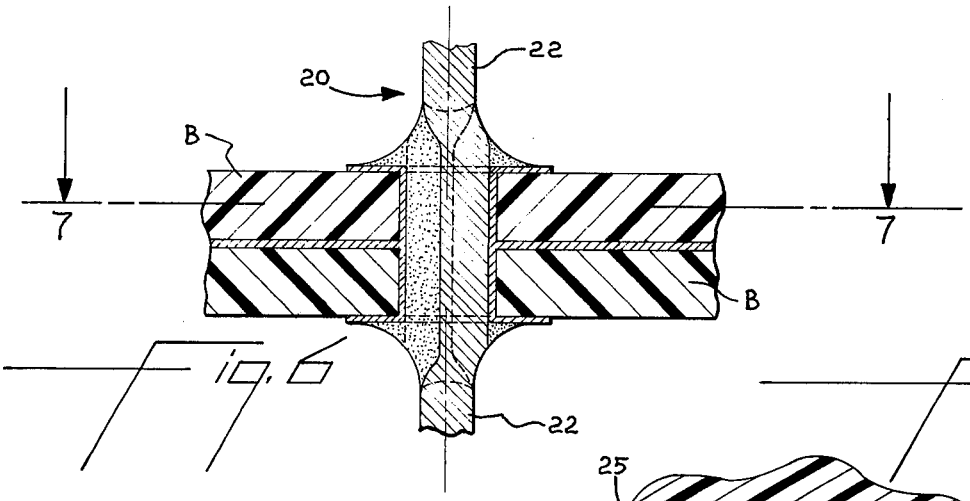
Fig. 6
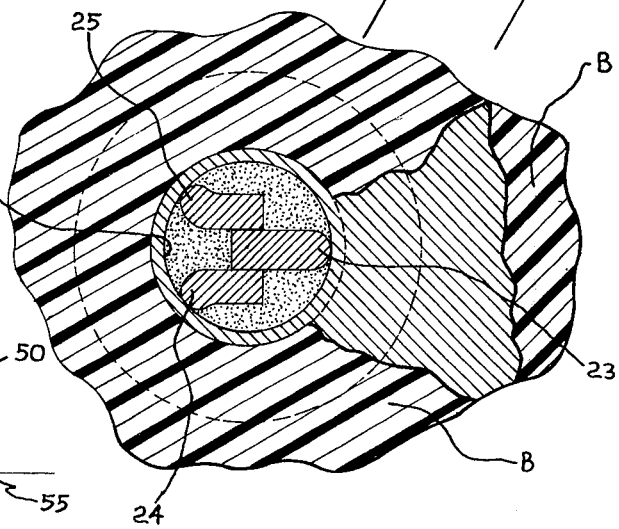
Fig. 7
Fig. 8
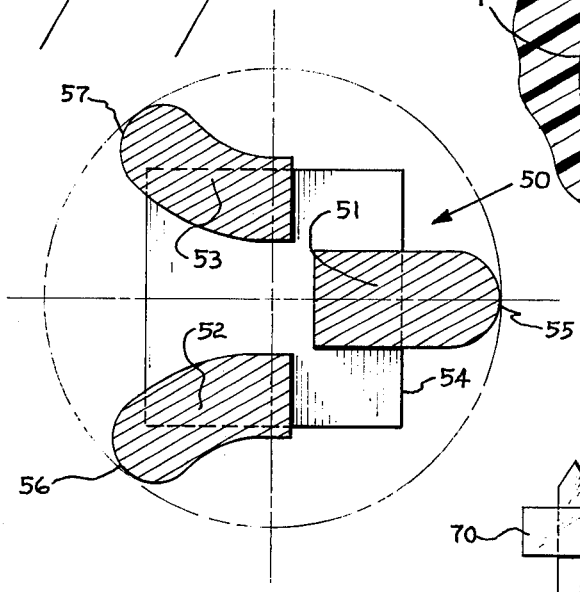
Fig. 9
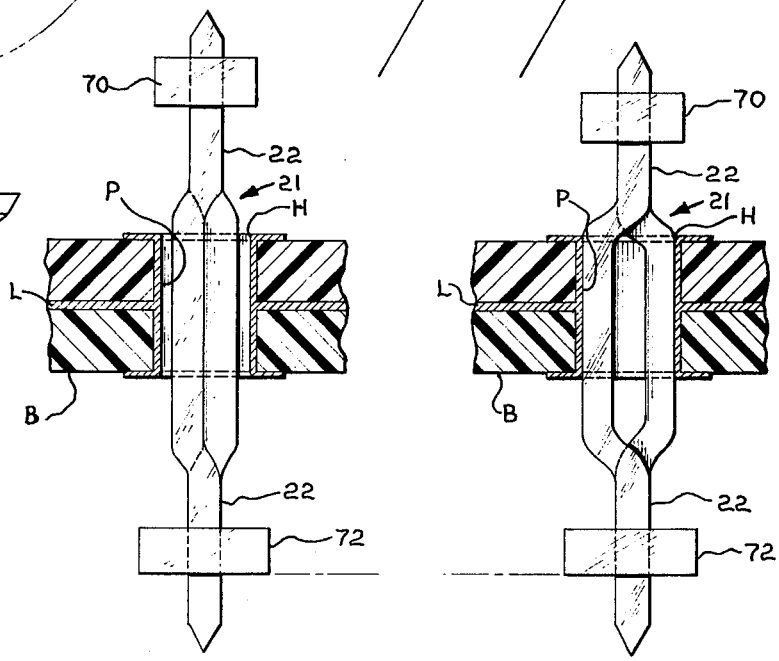
Fig. 10

CIRCUIT BOARD CONTACT

CROSS-REFERENCE TO RELATED APPLICATION

This application is a continuation-in-part application of U.S. Ser. No. 513,593 filed Oct. 10, 1974, now abandoned.

BACKGROUND OF THE INVENTION

1. Field of the Invention

This invention relates to an electrical circuit contact, and particularly relates to an electrical circuit contact including a mounting portion adapted for insertion in a plated hole in a circuit board.

2. Description of the Prior Art

Circuit board contacts including a mounting portion adapted for insertion in a hole in a circuit board are well known in the prior art and described in U.S. Pat. No. 3,827,004 and U.S. Pat. No. 3,634,819. The first mentioned patent describes a circuit board contact including a mounting portion and a solid, uniform cross section segment at each end of the mounting portion. The mounting portion includes four fins which are bent toward each other when the mounting portion is inserted in a hole in a circuit board. Although the four fins tend to collapse uniformly and accurately locate a central longitudinal axis of the mounting portion, they do not have sufficient resiliency to provide a high retention force for the mounting portion in a circuit board hole. The latter mentioned patent describes a circuit board contact including a mounting portion and solid, uniform cross section segment at each end of the mounting portion. In one embodiment of the contact described in this patent, the mounting portion includes two radial fins which are substantially free for resilient movement toward and away from each other. Although this configuration produces a high retention force when the mounting portion is inserted in a circuit board hole, the outer edges of the two fins which engage the circuit board hole are not sufficient to insure accurate location of the central axis of the mounting portion. In another embodiment of a contact described in this patent, a mounting portion includes three spring members, and a rolled, hollow segment at each end of the mounting portion. The three spring members provide for accurate location of the central axis of the mounting portion, however, the spring members being formed from flat stock and rolled do not have the resiliency of the fin-like structure of the previously described embodiment and do not provide as great a retention force.

The contact of the present invention provides for both accurately locating a central axis of the mounting portion and providing a high retention force for the mounting portion in a circuit board hole by using three resilient fins.

SUMMARY OF THE INVENTION

According to the present invention, a circuit board contact is provided comprising a mounting portion, and a solid, uniform cross section segment at each end of the mounting portion. The mounting portion comprises three fins extending along a length of the mounting portion. Each fin includes an edge adjacent a central longitudinal axis of the mounting portion. The edges of each adjacent fin are separated along a length of the mounting portion so that on insertion of the mounting portion in a hole in a circuit board, the fins may resiliently bend inwardly and provide a retention force for the mounting portion in a hole in a circuit board.

The three fins have a resilient structure which permits them to move toward and away from each other and provide a high retention force when the mounting portion is inserted in a circuit board hole. Additionally, the three fins insure more accurate location of a central longitudinal axis of the mounting portion in a circuit board hole.

Also provided is a method of mounting a contact in a circuit board hole comprising inserting a mounting portion of the contact loosely in a hole in a circuit board, supporting one end of the pin inserted in the hole, and compressing the other end of the pin to expand the mounting portion and provide an interference fit between the mounting portion and the hole in the circuit board.

The method of the present invention is particularly significant in inserting pins in multilayer circuit boards. Multilayer circuit boards may have many internal conductive layers internally connected by plated through holes. Such circuit boards are expensive to manufacture and may be irreparably damaged in the final stage of fabrication during insertion of the contacts in holes in the circuit board. The circuit board contacts of the prior art are inserted to provide an interference fit in the circuit board holes. The contacts may cut into the plating in the hole and destroy the internal interconnections rendering the board useless. The method of the present invention avoids this problem by inserting the mounting portion loosely in the circuit board hole, and expanding the fins of the mounting portion of the pin to provide an interference fit which can be controlled by controlling the force under which the pin is compressed. This avoids the possiblility of damage to the internal connections in a multilayer circuit board.

BRIEF DESCRIPTION OF THE DRAWINGS

FIG. 6 is a fragmented sectional view similar to FIG. 5 after soldering.

FIG. 7 is a view in cross section taken along line 7—7 of FIG. 6.

FIG. 8 is a view in cross section of another embodiment of the invention similar to FIG. 4.

FIG. 9 is a side view illustrating a method of the invention with a contact loosely inserted in a circuit board hole.

FIG. 10 is a view similar to FIG. 9, illustrating an expansion of a mounting portion of the pin.

DESCRIPTION OF PREFERRED EMBODIMENTS OF THE INVENTION

Figure 1:
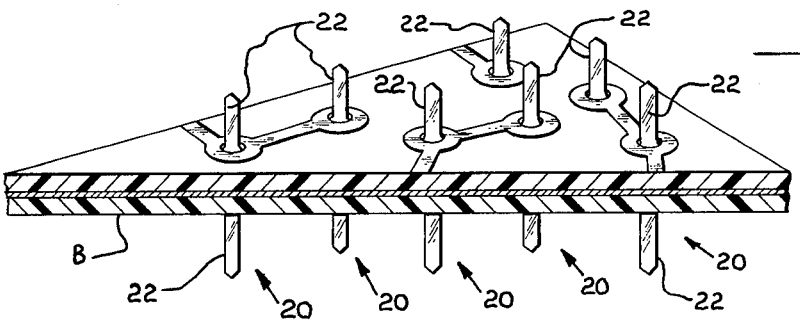
FIG. 1 is a perspective view of a multilayercircuit board with a number of contacts according to the invention mounted thereon.
Figure 2:
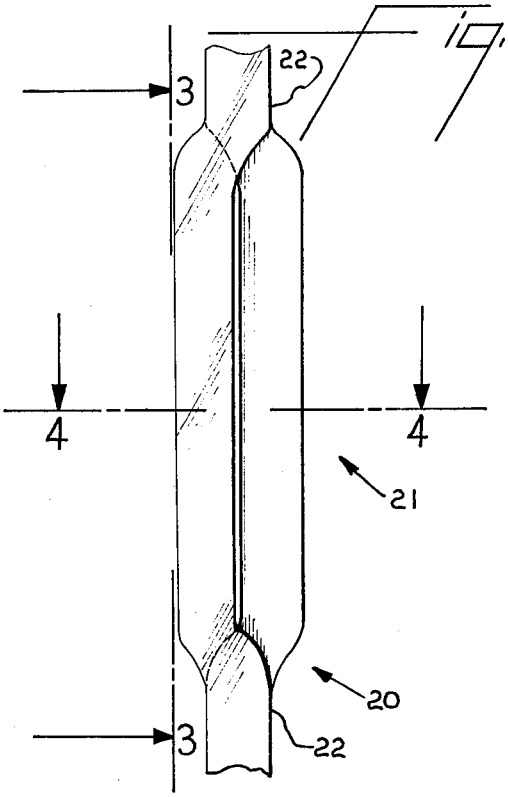
FIG. 2 is a fragmented side view of an embodiment of a contact of the invention.
Figure 3:
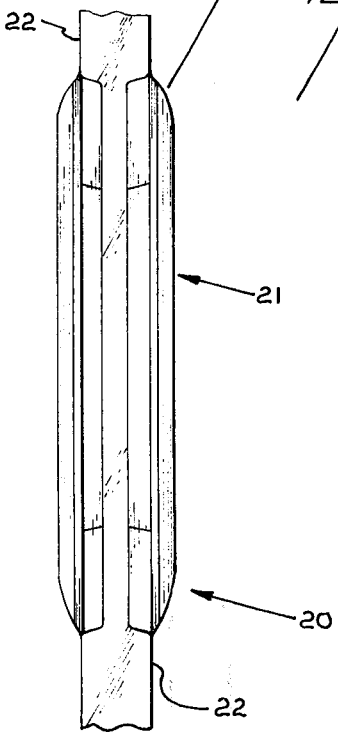
FIG. 3 is a view of the contact along line 3—3 of FIG. 2.

Preferred embodiments of the present invention are described below with reference to the attached drawings wherein the same numerals are used throughout the various views to identify the same elements.

A first embodiment of the contact 20 according to the invention is illustrated in FIGS. 1–7. The contact 20 comprises a deformed mounting portion 21, and a solid, uniform cross section segment 22 at each end of the mounting portion 21, e.g., a 0.025 inch square male pin. The mounting portion 21 comprises a radial fin 23 extending in a first direction, and a pair of fins 24, 25 laterally offset from the radial fin 23 and extending in a second direction away from fin 23. The radial fin 23 includes sides 26, 27, an interior edge 28, and an outer rounded edges 29. Sides 26, 27 join edge 28 to form corners 30, 31. Fin 24 includes sides 32, 33, an interior edge 34, and an outer rounded edge 35. Side 32 joins interior edge 34 to form corner 36. Fin 25 includes sides 37, 38, an interior edge 39, and an outer rounded edge 40. Side 37 joins edge 39 to form a corner 41. The opposing sides 32, 37 of fins 24, 25 are flared and diverge along their outer edges 35, 40 the interior edges 28, 34 of each of the fins 23, 24 and 25 being closely spaced and parallel with each other along a length of the central longitudinal axis.

Each fin 23, 24 and 25 extends along a length of the mounting portion 21 and is joined at its ends to the solid, uniform cross section segments 22 at each end of the mounting portion 21.

The mounting portion 21 may be formed by a stamping operation which forms the fins by deforming a solid, uniform cross section member, e.g., a 0.025 inch square circuit board pin, along a length of the mounting portion and lancing the interior adjacent edges of the fins formed to provide the separated edges adjacent a central longitudinal axis 42 of the deformed mounting portion 21. The edges adjacent the central longitudinal axis are separated from each other along a lateral dimension of the fins, and may be separated or overlap along a transverse dimension of the fins. The distance the fins are separated or overlap along the transverse dimension may be varied to adapt the mounting portion to various hole sizes. The edges being separated along the lateral dimension of the fins permits the fins to resiliently bend when the mounting portion is inserted in a hole in a circuit board. Although ideally the fins are of equal length, the radial fin has a tendency to be deformed or shortened; but this has no effect on the functionality of the mounting portion.

Figure 4:
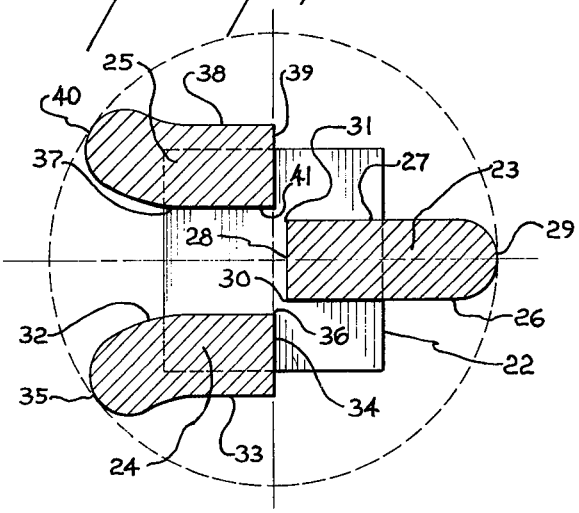
FIG. 4 is a view in cross section taken along line 4—4 of FIG. 2.
Figure 11:
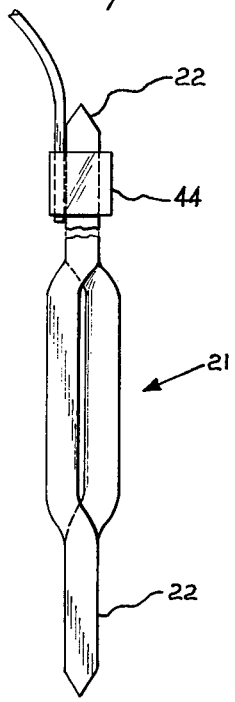
FIG. 11 illustrates a female disconnect terminal inserted over a contact of the invention.
Figure 12:
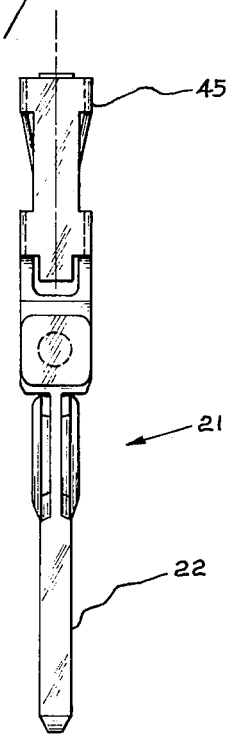
FIG. 12 illustrates a female disconnect terminal integrally formed on an end segment of a contact according to the invention.

As illustrated in FIG. 4, the outer rounded edges 29, 35 and 40 lie on a locus of a circle originating at the central longitudinal axis 42 of the mounting portion 21. When the mounting portion 21 is inserted in a plated hole H in a circuit board B having a diameter less than the diameter of the circle on which the outer rounded edges 29, 35 and 40 lie, the inward forces exerted on each fin cause the fins to flex or resiliently bend and avoids damage to the plated layer P within the hole and provides a high retention force of the mounting portion 21 in the hole. As illustrated in FIG. 7, the inward forces on the outer edges 29, 35 and 40 cause the fins to resiliently bend and the separated corners 30, 36 and 31, 41 permit the interior edges 28, 34 and 39 to overlap each other adjacent the central longitudinal axis 42 of the mounting portion 21. The insertion of the mounting portion 21 thus avoids damaging the plated layer P and any internal electrical connection between the plating P and an internal conductive layer L in a multilayer circuit board. Contacts 20 having end segments 22 comprising circuit board pins may be handled and inserted in holes in a circuit board using conventional insertion tooling in a given angular orientation to assure that the flat surfaces are properly aligned. The angular orientation is important in case a disconnect terminal 44 or a female socket 45 is attached to a contact, as illustrated in FIGS. 11 and 12.

Figure 5:
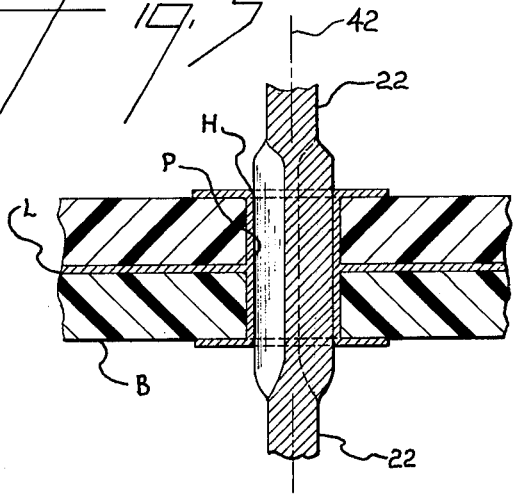
FIG. 5 is a fragmented sectional view showing a contact mounted in a plated through circuit board hole in a multilayer circuit board.

After the mounting portion 21 of a contact 20 is inserted in a hole H in a circuit board B, as illustrated in FIG. 5, the mounting portion is soldered either by hand or by conventional type soldering method, to provide a permanent electrical connection between the mounting portion 21 and plated circuitry on the board.

FIG. 8 illustrates another embodiment of a contact 50 according to the invention comprising a mounting portion having three fins 51, 52 and 53, and a solid, uniform cross section segment 54 (one shown) at each end of the mounting portion. The mounting portion is similar to that of contact 20 except fins 52, 53 diverge along their length so the outer rounded edges 55, 56 and 57 of each fin are spaced by 120°.

Figure 13:
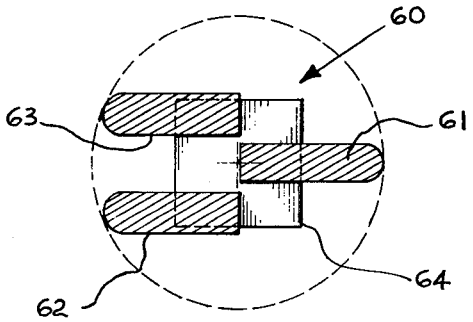
FIG. 13 is a view in cross section of another embodiment of the invention similar to FIG. 8.

Another embodiment of a contact 60 according to the invention is illustrated in FIG. 13 and comprises a mounting portion having three fins 61, 62, 63 and a solid uniform cross section segments 64 (one shown) at each end of the mounting portion. The mounting portion is similar to that of contacts 20 and 50, except the fins 62, 63 are parallel along their length.

Another embodiment of the invention comprises a method of mounting a contact in a hole in a circuit board. As illustrated in FIGS. 9 and 10, the method comprises inserting a contact 20 loosely in a hole in a circuit board by a suitable insertion means 70 which grips one end segment 22 of the contact. The outer end segment 22 is supported on the opposite side of the circuit board B by support means 72. The insertion means 70 applies a force to compress the pin 20 and expand the fins 23, 24 and 25 of the mounting portion 21 to provide an interference fit between the rounded edges 29, 35 and 40 and a plated layer P in the hole H. The interference fit holds the contact in the hole for subsequent soldering.

What is claimed is:

1. An elongated circuit board contact including a deformed mounting portion for insertion in a hole in a circuit board and a solid, uniform cross section segment at each end of the mounting portion, said segments having substantially the same cross section, said mounting portion consisting of a radial fin having an edge adjacent the longitudinal axis of the contact and a pair of fins laterally offset and extending in the opposite direction from the radial fin, each laterally offset fin having an edge adjacent said edge of the radial fin, each fin extending lengthwise of the mounting portion and being joined at its ends to said segments.

2. A contact as recited in claim 1, each fin additionally including a rounded outer edge located on the locus of a circle having said longitudinal axis as its center.

3. A contact as recited in claim 2, the outer edges of the laterally offset fins being flared and diverging from each other.

4. A contact as recited in claim 1, each segment at the end of said mounting portion comprising a circuit board pin.

5. An elongated circuit board contact including a mounting portion adapted for insertion in a hole in a circuit board and a solid, uniform cross section segment at each end of the mounting portion, said segments having substantially the same cross section, said mounting portion consisting of a radial fin including a pair of spaced sides, an outer edge, and an interior edge adjacent the longitudinal axis of the contact and a pair of fins laterally offset and extending in the opposite direction from said radial fin, each laterally offset fin including a pair of spaced sides, and outer edge, and an interior edge adjacent the interior edge of said radial fin, the interior edges of said fins being closely spaced and extending lengthwise of the mounting portion substantially parallel with each other, each fin being joined at its ends to said segments.

6. A contact as recited in claim 5, the outer edge of each fin being rounded and lying on the locus of a circle having said longitudinal axis as its center.

7. A contact as recited in claim 6, the outer edge of each laterally offset fin being flared and diverging from the outer edge of the other laterally offset fin.

8. A contact as recited in claim 5, each segment at the end of said mounting portion comprising a circuit board pin.

* * * * *